US008147058B2

(12) United States Patent
Okamoto

(10) Patent No.: US 8,147,058 B2
(45) Date of Patent: Apr. 3, 2012

(54) INKJET RECORDING APPARATUS

(75) Inventor: Akira Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 12/479,040

(22) Filed: Jun. 5, 2009

(65) Prior Publication Data

US 2009/0303273 A1 Dec. 10, 2009

(30) Foreign Application Priority Data

Jun. 6, 2008 (JP) ..... 2008-149368

(51) Int. Cl.
*B41J 2/01* (2006.01)

(52) U.S. Cl. ..... 347/104; 347/14

(58) Field of Classification Search ..... 347/14, 347/16, 102, 104
See application file for complete search history.

(56) References Cited

U.S. PATENT DOCUMENTS 5,223,858 A * 6/1993 Yokoi et al. ..... 346/134
5,489,926 A * 2/1996 Arbeiter ..... 347/16
5,714,990 A * 2/1998 Courtney ..... 347/14
5,738,457 A * 4/1998 Ishida et al. ..... 400/706
6,149,327 A * 11/2000 Ward et al. ..... 400/582
2002/0196300 A1 * 12/2002 Takahashi et al. ..... 347/14
2007/0126836 A1 * 6/2007 Masuyama et al. ..... 347/103
2007/0247651 A1 * 10/2007 Maehira ..... 358/1.12
2008/0001983 A1 * 1/2008 Kawakami et al. ..... 347/14

FOREIGN PATENT DOCUMENTS

JP 7-205416 8/1995
JP 2002-103583 4/2002
JP 2005238608 A * 9/2005
JP 2007030206 A * 2/2007
JP 2007-118451 5/2007

* cited by examiner

*Primary Examiner* — Charlie Peng
*Assistant Examiner* — Peter Radkowski
(74) *Attorney, Agent, or Firm* — Canon USA Inc. IP Division

(57) ABSTRACT

An inkjet recording apparatus includes a feed control unit configured to start feed of a next page before recording of a current page by a recording head is completed; an ejection wait time management unit configured to manage a time until the current page contacts a previous page which has been ejected by an ejection unit; and an ejection permission unit configured to permit ejection of the current page by the ejection unit after the time managed by the ejection wait time management unit becomes zero. The feed control unit does not start the feed of the next page until the ejection permission unit permits the ejection of the current page.

13 Claims, 11 Drawing Sheets

FIG. 11

| INK AMOUNT PER UNIT AREA | EJECTION WAIT TIME |
|---|---|
| 0% TO 49% | 0 SEC |
| 50% TO 69% | 10 SEC |
| 70% TO 84% | 20 SEC |
| 85% TO 100% | 30 SEC |

FIG. 12

| PRINTING MODE | THRESHOLD VALUE X |
|---|---|
| BLACK AND WHITE | 150 mm |
| COLOR | 100 mm |

INKJET RECORDING APPARATUS

BACKGROUND OF THE INVENTION

1. Field of the Invention

The present invention relates to an inkjet recording apparatus, and more particularly to perform recording by discharging ink from a recording head on a recording medium.

2. Description of the Related Art

An inkjet recording apparatus performs recording by discharging ink from a recording head on a recording medium. In recent years, such an inkjet recording apparatus is rapidly spread because of advantages of low noise, low operating cost, and ease of forming a color image. However, when recording is made on a standard sheet, problems relating to initial quality, such as image blur, change in color density or color tone, or setoff, may appear. In addition, problems relating to image fastness, such as insufficiency in water resistance or weather resistance, may appear.

Japanese Patent Laid-Open No. 2002-103583 discloses an image recording apparatus that includes a preprocess liquid application unit including an application roller for applying preprocess liquid to a recording region of a recording medium, and an image recording unit for recording an image on the recording region of the recording medium with the preprocess liquid applied. Japanese Patent Laid-Open No. 2002-103583 teaches that driving of a pair of conveyance rollers that conveys the recording medium with the preprocess liquid applied by the preprocess liquid application unit is independent from driving of the application roller. In a state of intermittent conveyance during recording, the application roller is rotationally driven at a constant speed while the driving of the application roller is independent from the driving of the pair of conveyance rollers. Hence, cockling or image-quality unevenness due to application unevenness does not appear. An application condition with the application roller is kept constant.

In addition, Japanese Patent Laid-Open No. 2007-118451 discloses a configuration that, when continuous printing is performed, starts feed of a next page of recording sheets before recording of a previous page is completed to increase a throughput. The configuration disclosed in Japanese Patent Laid-Open No. 2007-118451 includes an image data analysis unit that analyzes image data of the previous page during the continuous printing, and a printing time calculation unit that calculates a time necessary for printing of the previous page on the basis of the image data analysis. Japanese Patent Laid-Open No. 2007-118451 discloses that a feed timing of the next page is determined on the basis of the printing time calculation result and a recording-sheet size.

Further, Japanese Patent Laid-Open No. 7-205416 discloses a configuration that, when recording has been performed on an ejected previous printing medium with a large application amount of ink per unit area, a wait time is provided so that a next printing medium does not contact the recorded region for a certain time, in order to prevent smear due to the ejected printing medium.

In the configuration that applies the preprocess liquid to the recording medium by the application roller before the recording is performed by the recording head, it is described that the feed of the next page is started before the recording of the current page is completed to increase the throughput. However, if the recording has been performed on the previous page ejected by the ejection unit before the recording of the current page with a large application amount of ink per unit area, the recording of the current page has to be occasionally interrupted. In this situation, a front edge of the precedently fed next page collides with a rear edge of the current page, possibly resulting in conveyance defect. In addition, when the application for the next page is interrupted to prevent the front edge of the next page from colliding with the rear edge of the current page, an application amount of the preprocess liquid to the next page may become uneven. An image to be recorded on the next page may be deteriorated.

SUMMARY OF THE INVENTION

An embodiment of the present invention provides a recording apparatus capable of providing recording with high image quality while preventing smear due to an ejected sheet from occurring, in a configuration that applies preprocess liquid to a recording medium by an application roller before a recording head performs recording.

According to an aspect of the present invention, an inkjet recording apparatus is provided. The apparatus includes a feed unit configured to feed a recording medium, an application unit configured to apply liquid to the recording medium fed by the feed unit, a recording unit configured to perform recording by discharging ink from a recording head on the recording medium with the liquid applied by the application unit, an ejection unit configured to eject the recording medium after the recording is performed by the recording unit, a feed control unit configured to, when the recording medium includes a plurality of pages, start feed of a next page by the feed unit before recording of a current page by the recording head is completed, an ejection wait time management unit configured to manage a time until the current page contacts a previous page which has been ejected by the ejection unit, and an ejection permission unit configured to permit ejection of the current page by the ejection unit after the time managed by the ejection wait time management unit becomes zero. The feed control unit does not start the feed of the next page until the ejection permission unit permits the ejection of the current page.

Further features of the present invention will become apparent from the following description of exemplary embodiments with reference to the attached drawings.

BRIEF DESCRIPTION OF THE DRAWINGS

FIG. 11 is a table showing a relationship between an ink amount per unit area and an ejection wait time according to the embodiment of the present invention.

FIG. 12 is a table showing a relationship between a printing mode and a threshold value X according to the embodiment of the present invention.

DESCRIPTION OF THE EMBODIMENTS

Embodiments of the present invention are described below in detail with reference to the attached drawings.

An embodiment of the present invention relates to a multifunction apparatus including an original reading apparatus and an inkjet recording apparatus. In particular, the embodiment of the present invention relates to an inkjet recording apparatus including a liquid application unit that applies liquid to a recording medium for a certain purpose, such as to promote cohesion of a pigment when recording uses ink having the pigment as a color material.

Figure 1:
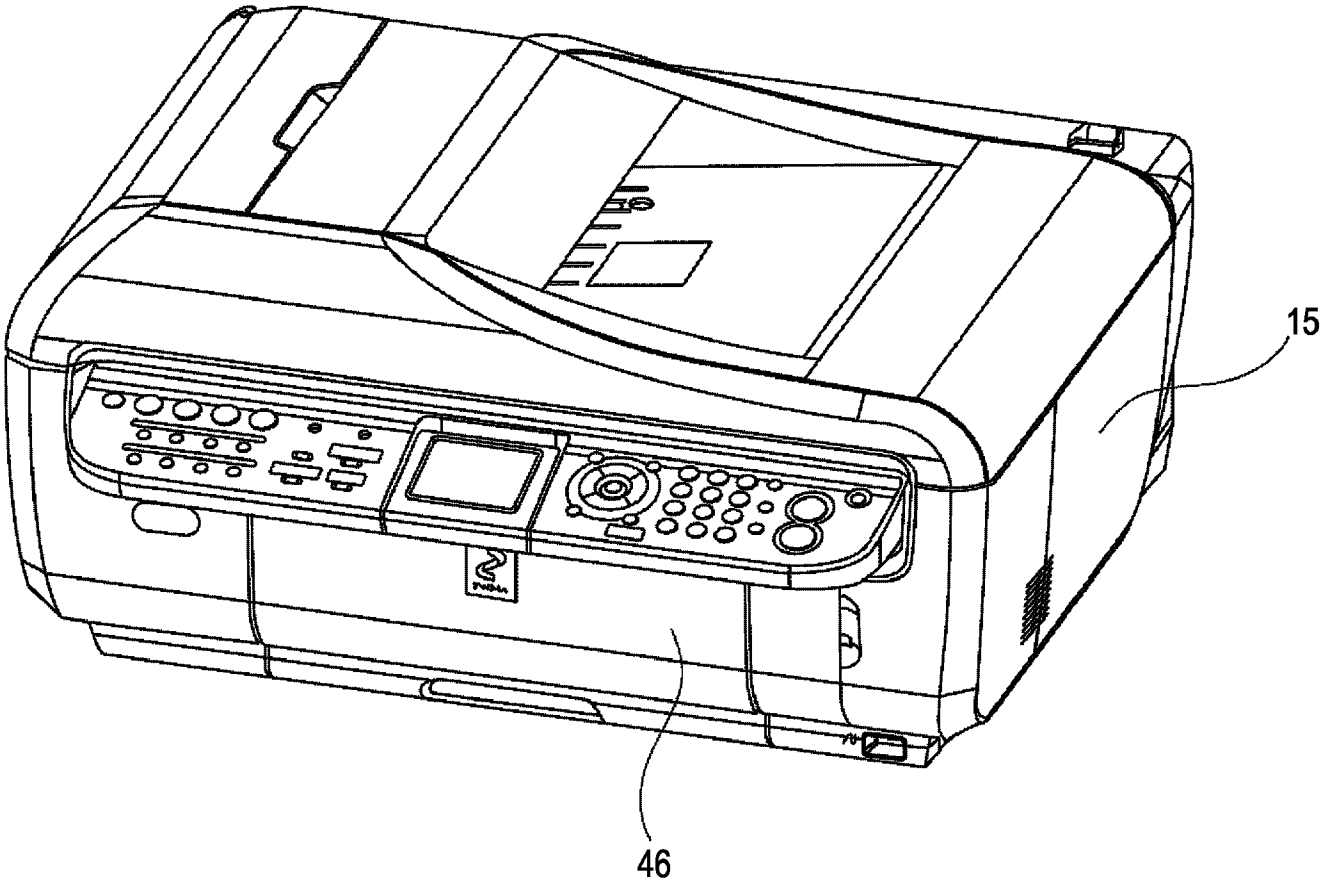
FIG. 1 is a perspective view showing the appearance of a multifunction apparatus using an inkjet recording apparatus according to an embodiment of the present invention.
Figure 2:
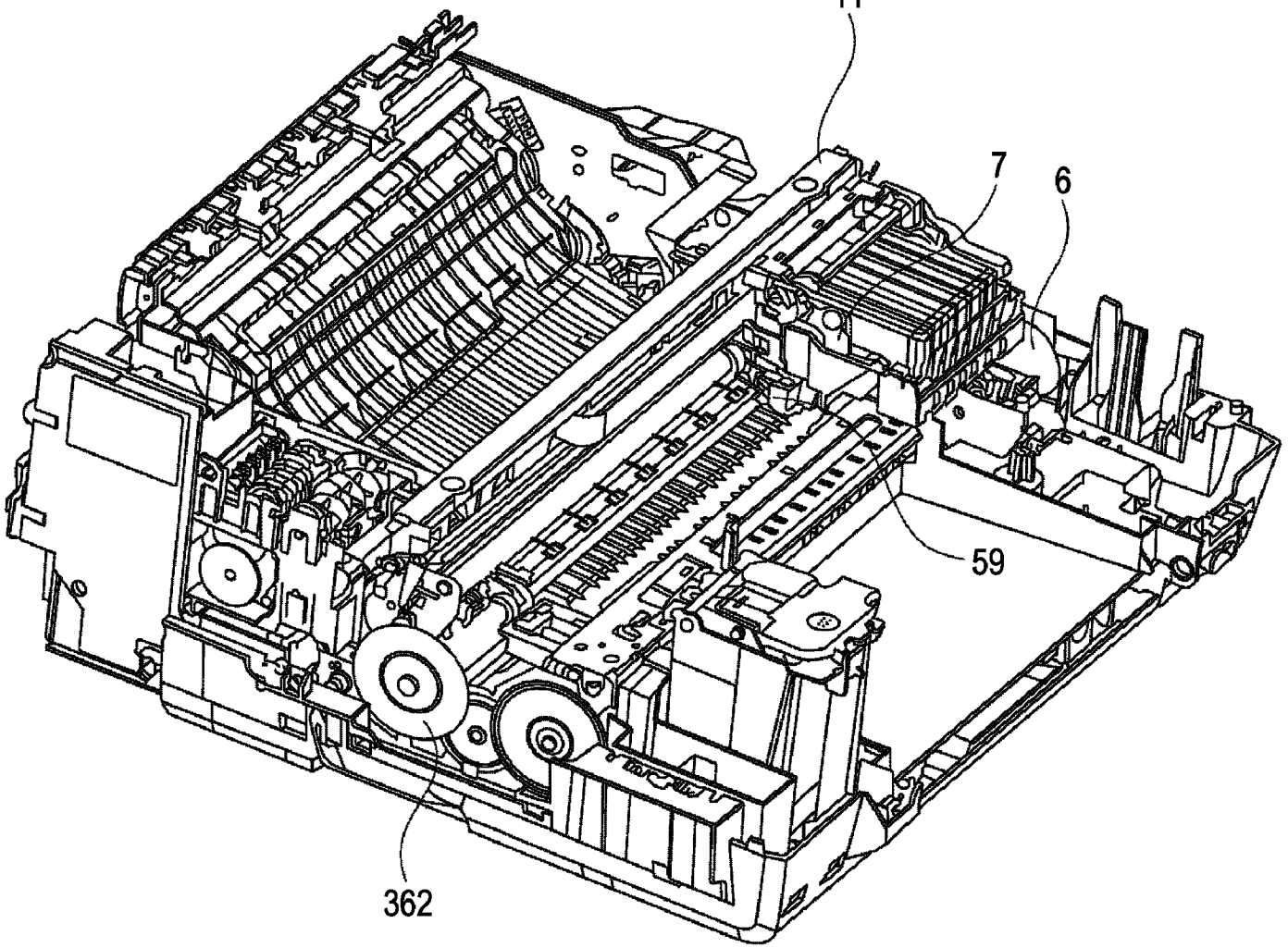
FIG. 2 is a perspective view showing a front left side of an inner structure of the recording apparatus.
Figure 3:
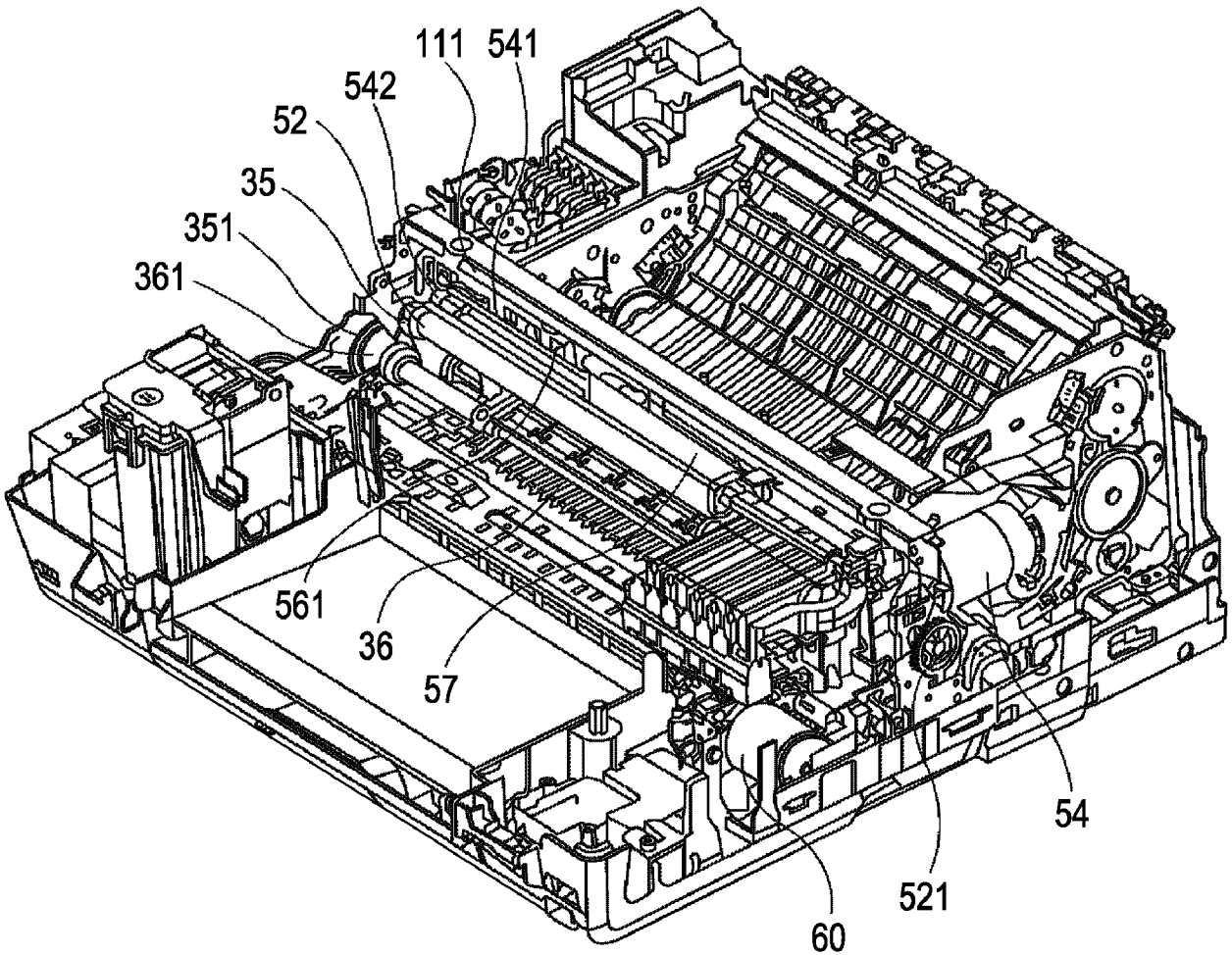
FIG. 3 is a perspective view showing a front right side of the inner structure of the recording apparatus.
Figure 4:
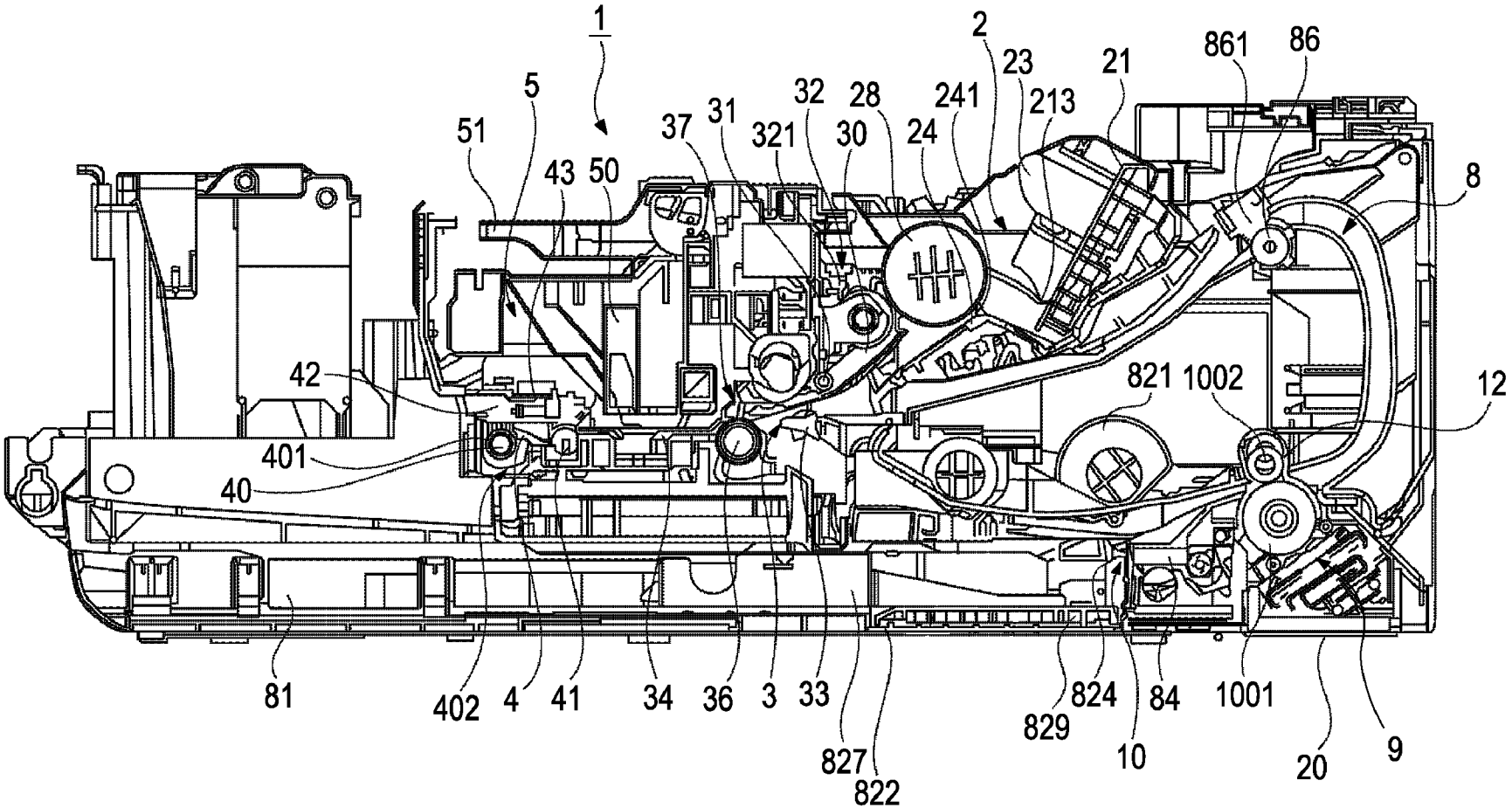
FIG. 4 is a longitudinal sectional view showing the inner structure of the recording apparatus.

FIG. 1 is a perspective view showing the appearance of the multifunction apparatus. FIGS. 2 and 3 are perspective views respectively showing a front left side and a front right side of an inner structure of a recording apparatus shown in FIG. 1 after an outer casing of the multifunction apparatus is removed. FIG. 4 is a longitudinal sectional view showing the inner structure of the recording apparatus. In FIG. 1, an outer casing unit 15 of the multifunction apparatus mainly includes an outer casing, an operation panel, and an ejection tray 46. The outer casing unit 15 contains the recording apparatus (described later).

Referring to FIGS. 2 to 4, a recording apparatus 1 includes an ASF feed unit 2, a conveyance unit 3, an ejection unit 4, a carriage unit 5, a recovery mechanism (cleaning unit) 6, a recording unit including a recording head 7, a U-turn conveyance unit, and a duplex conveyance unit (for two-sided printing) 8. The recording apparatus 1 also includes, as a liquid application mechanism, an application passage, a liquid circulation unit 9, a cassette feed unit 10, and a liquid application unit 12.

In this embodiment, when a dedicated sheet for recording with photograph image quality is used, the sheet is fed from the ASF feed unit 2. When a standard sheet such as a copier sheet is used, the sheet is fed from the cassette feed unit 10. This is because the thickness of the dedicated sheet is relatively large and it is desired to reduce a load change due to the stiffness of the sheet. Hence, the sheet is fed from an ASF which has a substantially straight path. For business use of the standard sheet, it is expected that the number of recording sheets and the frequency of recording are large. Hence, the sheet is fed from a cassette on which a large number of sheets can be stacked. In a recording operation, briefly describing, the recording head 7 mounted on the carriage unit 5 provides recording while the conveyance unit 3 conveys a recording sheet (recording medium) fed from the ASF feed unit 2 (first feed port). Then, the sheet is ejected and stacked on the ejection unit 4 including the ejection tray 46 which is integral with a front cover. The recording sheet fed from the cassette feed unit 10 (second feed port) passes through the liquid application unit 12, the U-turn conveyance unit, the duplex conveyance unit 8, and the conveyance unit 3, is provided with recording by the recording head 7, and then is ejected and stacked on the ejection unit 4. Now, the details of these mechanical units are described in sequence.

The ASF feed unit 2 is configured such that a pressure plate 21 on which a recording sheet is stacked, a feed roller 28 for feeding the recording sheet, a separation roller 241 for separating the recording sheet, a return lever for returning the recording sheet to a stacked position, and the like, are attached to a base 20. A feed tray (not shown) for retaining the stacked recording sheet is attached to the base 20 or the outer casing unit 15. The feed tray is multistage type. The tray is pulled when it is used. The feed roller 28 is a rod-like member having an arcuate cross-section. A feed roller rubber is provided at a position close to a sheet reference, so that the recording sheet is fed by the feed roller rubber. A drive source of the feed roller 28 is a motor (hereinafter, referred to as feed motor) provided at the ASF feed unit 2. The motor also serves as a drive source of the recovery mechanism 6 (described later). A drive force of the motor is transmitted via, for example, a drive transmitting gear and a planet gear, to drive the feed roller 28.

The pressure plate 21 is provided with a movable side guide 23 which regulates the stacked position of the recording sheet. The pressure plate 21 is rotatable around a rotation shaft provided at the base 20. The pressure plate 21 is urged against the feed roller 28 by a pressure plate spring. A separation sheet 213 is provided at a unit of the pressure plate 21 facing the feed roller 28, to prevent double feeding of recording sheets. The separation sheet 213 is made of a material with a large frictional coefficient. The pressure plate 21 can change its position by a pressure plate cam such that the pressure plate 21 contacts or be separated from the feed roller 28. Further, a separation roller holder 24 is attached to the base 20 rotatably around a rotation shaft. The separation roller holder 24 holds the separation roller 241. The separation roller 241 is urged against the feed roller 28 by a separation roller spring. A clutch spring is attached to the separation roller 241. The separation roller 241 is rotatable when a predetermined or higher load is applied. The separation roller 241 contacts or be separated from the feed roller 28 by a separation roller release shaft and a control cam. The positions of the pressure plate 21, the return lever, and the separation roller 241 are detected by an ASF sensor. The return lever for returning the recording sheet to the stacked position is rotatably attached to the base 20. The return lever is urged in a release direction by a return lever spring. To return the recording sheet to the stacked position, the return lever is rotated by the control cam.

In a normal standby state, the pressure plate 21 is released by the pressure plate cam, and the separation roller 241 is released by the control cam. The return lever is arranged at a position so as to return the recording sheet to the stacked position, and to close a stack port, thereby inhibiting the stacked recording sheet from moving to a far side. When feed of the recording sheet starts in the standby state, the separation roller 241 contacts the feed roller 28 by driving of the motor. Then, the return lever is released, and the pressure plate 21 contacts the feed roller 28. In this state, the feed of the recording sheet to the inside of the apparatus is started.

The number of sheets to be fed by the feed roller 28 is regulated by a first regulation unit provided at the base 20. Several recording sheets are fed to a nip portion between the feed roller 28 and the separation roller 241. The fed recording sheets are separated at the nip portion. Only a top recording sheet is fed to the inside of the apparatus. When the recording sheet reaches a nip portion between a conveyance roller 36 and a pinch roller 37, the pressure plate 21 is released by the pressure plate cam, and the separation roller 241 is released by the control cam. The control cam returns the return lever to the stacked position, where the recording sheet returns to the stacked position. At this time, second or later recording sheets fed to a position near the nip portion between the feed roller 28 and the separation roller 241 are returned to the stacked position.

It is assumed that recording sheets to be set in a cassette 81 are standard sheets such as copier sheets. In the cassette 81, a pressure plate 822 is provided. A recording sheet is stacked on the pressure plate 822. Also, the pressure plate 822 presses the recording sheet against a feed roller 821 to separate and feed the recording sheet. A U-turn base 84 defining a main body of the U-turn conveyance unit and the duplex conveyance unit 8 includes the above-described feed roller 821, a separation roller, a return lever 824 that returns the recording sheet to a stacked position, and a control mechanism that controls the pressure plate 822 to contact or to be separated from the feed roller 821. The cassette 81 has a two-stage expandable/contractible structure, and the two stages are selectively used depending on the size of recording sheet. When small-size recording sheets are stacked, or when the cassette 81 is not used, the cassette 81 can be contracted, and housed in the outer casing unit 15.

The feed roller 821 is a rod-like member having an arcuate cross-section. A feed roller rubber is provided at a position close to a sheet reference, so that the recording sheet is fed by the feed roller rubber. A duplex conveyance motor is provided at the duplex conveyance unit 8. A drive force of the motor is transmitted via, for example, a drive transmitting gear and a planet gear, to drive the feed roller 821. The pressure plate 822 is provided with a movable side guide 827 which regulates the stacked position of the recording sheet. The pressure plate 822 is rotatable around a rotation shaft arranged at the cassette 81. The pressure plate 822 is urged against the feed roller 821 by, for example, a pressure plate spring arranged between the pressure plate 822 and the U-turn base 84. A separation sheet 829 is provided at a unit of the pressure plate 822 facing the feed roller 821, to prevent double feeding of recording sheets. The separation sheet 829 is made of a material with a large frictional coefficient. The pressure plate 822 can contact or be separated from the feed roller 821 by a pressure plate cam.

The separation roller is supported rotatably with respect to the separation roller holder which is rotatable around the shaft provided at the separation base. The separation roller holder is urged against the feed roller 821 by a separation roller spring. A clutch spring is attached to the separation roller. The separation roller is rotated when a predetermined or higher load is applied. The separation roller contacts or is separated from the feed roller 821 by a separation roller release shaft and a control cam. The positions of the pressure plate 822, the return lever 824, and the separation roller are detected by a U-turn sensor.

The return lever 824 for returning the recording sheet to the stacked position is attached to the U-turn base 84. The return lever 824 is urged in a release direction by a return lever spring. To return the recording sheet, the return lever 824 is rotated by a control cam. In a normal standby state, the pressure plate 822 is released by the pressure plate cam, and the return lever 824 returns the recording sheet to the stacked position. The return lever 824 is arranged at a position to close a stack port, thereby inhibiting the stacked recording sheet from moving. When feed of the recording sheet starts in the standby state, the separation roller contacts the feed roller 821 by driving of the motor. Then, the return lever 824 is released, and the pressure plate 822 contacts the feed roller 821. In this state, the feed of the recording sheet is started.

The movement of the recording sheet is regulated by a first regulation unit provided at the separation base. Several recording sheets are fed to a nip portion between the feed roller 821 and the separation roller. The fed recording sheets are separated at the nip portion. Only a top recording sheet is fed to the downstream side. When the separated and conveyed recording sheet is conveyed to a nip portion between a first U-turn roller 86 and a first U-turn pinch roller 861, the pressure plate 822 is released by the pressure plate cam, and the separation roller is released by the control cam. The return lever 824 is restored to the stacked position by the control cam. At this time, second or later recording sheets fed to the nip portion between the feed roller 821 and the separation roller are returned to the stacked position.

The conveyance unit 3 includes a chassis 11 formed by bending a sheet metal member, the chassis 11 serving as a structure member. In particular, the conveyance unit 3 includes the conveyance roller 36 and a paper end (PE) sensor 32. The conveyance roller 36 has a structure in which a surface of a metal shaft is coated with fine ceramic particles. Metal units at both ends of the conveyance roller 36 are supported by bearings provided at the chassis 11. In addition, conveyance roller tension springs are provided between the bearings and the conveyance roller 36. The tension springs apply loads to the conveyance roller 36 during rotation, thereby providing stable conveyance.

A plurality of pinch rollers 37 held by the pinch roller holder 30 contact the conveyance roller 36. Thusly, an urging force of a pinch roller spring 31 is applied to the pinch roller holder 30. With this structure, the pinch roller 37 presses a recording sheet to the conveyance roller 36, thereby generating a conveyance force of the recording sheet. At this time, the rotation shaft of the pinch roller holder 30 is supported by the bearings of the chassis 11.

Also, a guide flapper 33 and a platen 34 are arranged at the entrance of the conveyance unit 3 to which the recording sheet is conveyed. The guide flapper 33 and the platen 34 guide the recording sheet. A PE sensor lever 321 is arranged at the pinch roller holder 30. The PE sensor lever 321 is rotated when the recording sheet contacts the PE sensor lever 321. The PE sensor 32 detects that the PE sensor lever 321 is rotated because the front and rear edges of the recording sheet pass through the PE sensor lever 321. The PE sensor 32 calculates the position of the recording sheet. The platen 34 is attached to the chassis 11. The guide flapper 33 is supported rotatably around a shaft coaxially with the bearings of the conveyance roller 36. The guide flapper 33 is positioned while contacting a unit of the chassis 11.

With the above-mentioned structure, the recording sheet conveyed from the feed unit to the conveyance unit 3 is guided by the pinch roller holder 30 and the guide flapper 33, and conveyed to the nip portion between the conveyance roller 36 and the pinch roller 37. At this time, the front edge of the conveyed recording sheet is detected by the PE sensor lever 321, so that a recording position of the recording sheet in the recording unit is determined. The recording sheet is conveyed on the platen 34 when the conveyance roller 36 is rotationally driven by the drive force of a conveyance motor 35. Also, a rib is formed on the platen 34. A back surface of the conveyed recording sheet contacts the rib. The rib controls a gap between the recording head 7 and the recording sheet, and, in association with the ejection unit 4, prevents the recording sheet from cockling. The conveyance roller 36 is driven by transmitting a torque of the conveyance motor 35, which is a DC motor, to a pulley 361 coaxial with the conveyance roller 36 via a timing belt 351. In addition, to detect a rotation amount of the conveyance roller 36, a code wheel 362 with marking at a pitch ranging from 150 to 300 lpi is mounted coaxially with the conveyance roller 36. An encoder sensor is attached to the chassis 11. The encoder sensor reads the marking of the code wheel 362.

The carriage unit 5 includes a carriage 50 that moves while the recording head 7 is mounted thereon. The carriage 50 moves while being guided by a guide shaft 52 arranged along a direction intersecting with a conveyance direction of the recording sheet. The carriage 50 is slidably supported by a guide rail 111 arranged in parallel to the guide shaft 52. The posture of the carriage 50 is retained such that a gap between the recording head 7 and the recording sheet is maintained. The guide shaft 52 is attached to the chassis 11. The guide rail 111 is integral with the chassis 11.

The carriage 50 is driven by a carriage motor 54 attached to the chassis 11, via a timing belt 541. The timing belt 541 is supported with a predetermined tension applied by an idle pulley 542. The timing belt 541 is coupled to the carriage 50 via a damper made of, for example, rubber. The damper can attenuate vibration of the carriage motor 54, thereby reducing image unevenness. To detect the position and movement of the carriage 50, a code strip 561 with marking at a pitch ranging from 150 to 300 lpi is arranged in parallel to the timing belt 541. Also, an encoder sensor for reading the marking of the code strip 561 is arranged on a carriage substrate of the carriage 50.

A contact is provided at the carriage substrate for electrical connection with the recording head 7. A flexible flat cable 57 is connected to the carriage 50, to transmit, for example, a head drive signal, from an electric substrate of a main body of the recording apparatus to the recording head 7. The carriage 50 is provided with a contact unit for positioning the recording head 7, and a head set lever 51 for urging and fixing the recording head 7.

Eccentric cams 521 are fixed to both ends of the guide shaft 52. The drive force of the above-described feed motor is transmitted to the eccentric cams 521 via a gear train of a main cam of the recovery mechanism 6. With the structure, the guide shaft 52 can be lifted or lowered, so that an optimum gap is provided for recording sheets with various thicknesses. The carriage 50 has an automatic registration adjustment sensor 59 for automatically correcting a landing shift of ink discharged from the recording head 7 and landing on the recording sheet. The sensor 59 is a reflection-type optical sensor. The sensor 59 receives light emitted from a light-emitting element and reflected by an image pattern on a recording sheet, and obtains an optimum registration adjustment value.

The recording head 7 that discharges ink in accordance with recording data, and an ink tank that reserves ink to be supplied to the recording head 7 are detachably attached to the carriage 50. The recording head 7 has five nozzle rows that respectively discharge inks of yellow (Y), magenta (M), cyan (C), black (Bk), and photo-black (PBk). Also, five ink tanks are provided in correspondence with the five nozzle rows. The five-color inks have color materials of pigments. Cohesion of the pigments is promoted by preprocess liquid (described later). Accordingly, high image quality, for example, increased density, can be provided. Also, image fastness can be improved.

The recording head 7 has a plurality of ink passages respectively coupled to the color ink tanks. The ink passages respectively communicate with the five nozzle rows. Ink ejection actuators are arranged in a plurality of nozzles defining each nozzle row. The actuators each use a film boiling pressure of liquid by an electrothermal conversion member (heating element).

The ejection unit 4 includes a first ejection roller 41, a second ejection roller 40, a driven roller 42 urged against and driven by the ejection rollers 40 and 41, and a gear train that transmits the drive force of the conveyance roller 36 to the ejection rollers 40 and 41. The ejection rollers 40 and 41 are rotatably attached to the platen 34. The second ejection roller 40 arranged at the downstream side in the conveyance direction of the recording sheet has a plurality of rubber pieces 401 fixed to a metal shaft thereof. The drive force of the conveyance roller 36 is transmitted to the second ejection roller 40 via an idle gear. The first ejection roller 41 arranged at the upstream side in the conveyance direction of the recording sheet has a plurality of elastic pieces of elastomer attached to a resin shaft thereof. Driving of the second ejection roller 40 is transmitted to the first ejection roller 41 via an idle gear.

The driven roller 42 is formed by integrally molding a thin stainless plate with a resin part. The thin plate has a plurality of protruding parts in a peripheral area of the thin plate. A plurality of the driven rollers 42 is attached to a driven roller holder 43. A driven roller spring made of a rod-like coil spring causes the driven rollers 42 to be attached to the driven roller holder 43, and presses the driven rollers 42 against the ejection rollers 40 and 41. Some of the plurality of driven rollers 42 are arranged at positions corresponding to the rubber pieces 401 of the second ejection roller 40 or positions corresponding to the elastic pieces of the first ejection roller 41, so as to generate a conveyance force of the recording sheet. Also, some of the plurality of driven rollers 42 are arranged at positions not corresponding to the rubber pieces 401 or the elastic pieces, so as to prevent the recording sheet from being lifted.

A sheet end support is arranged between the ejection rollers 40 and 41. The sheet end support lifts both ends of the recording sheet and holds the recording sheet. With the structure, it is prevented that a recorded image on a recording sheet which is ejected first is rubbed with and damaged by a recording sheet which is ejected second. Regarding the sheet end support, a sheet end support spring urges a resin member with a driven roller at a tip end of the resin member. Accordingly, the driven roller is pressed to the recording sheet with a predetermined pressure, and both ends of the recording sheet are lifted.

The recording sheet with an image recorded by the recording unit is pinched and conveyed by the first ejection roller 41 and the driven roller 42, and is ejected on the ejection tray 46. The ejection tray 46 can be housed in the front cover, and is pulled when it is used. The height of the ejection tray 46 is increased toward the tip end thereof. Also, heights of both ends of the ejection tray 46 are increased. Hence, a stacking property for ejected recording sheets is improved, and image formation surfaces of the recording sheets are not rubbed. In addition, an ejection roller cleaner 402 is rotatably supported by a spring shaft. The ejection roller cleaner 402 is pressed to the rubber pieces 401 of the second ejection roller 40. The ejection roller cleaner 402 includes a cleaner unit and a holder unit. The cleaner unit is driven with the rubber pieces 401 to remove paper dusts or the like adhering to and deposited on the surfaces of the rubber pieces 401. The holder unit holds the cleaner unit. The cleaner unit is desirably made of porous urethane containing a large number of fine air bubbles with a size ranging of about 50 to 200 μm.

The recovery mechanism 6 includes a pump 60 that sucks ink from the nozzles of the recording head 7, a cap that prevents the nozzles of the recording head 7 from being dried, and a wiper that wipes out a peripheral area of the nozzles of the recording head 7. With the structure, an ink discharging performance of the recording head 7 can be maintained and recovered. The recovery mechanism 6 mainly uses the drive force of the above-described feed motor. In particular, a one-way clutch is provided such that rotation in a direction of the feed motor causes the pump 60 to operate, and rotation in the opposite direction causes a wiping operation of the wiper and a capping/uncapping operation of the cap to be performed.

Next, operations of the liquid application unit 12, the U-turn conveyance unit, and the duplex conveyance unit 8 when a recording sheet is fed from the cassette is described according to the embodiment of the present invention.

The liquid application unit 12 is provided at the downstream side in the feeding direction of the recording sheet fed from the cassette feed unit 10. The U-turn conveyance unit is provided downstream of the liquid application unit 12. Liquid is applied to a recording surface of the recording sheet fed from the cassette feed unit 10 when the recording sheet passes through the liquid application unit 12. Then, the recording sheet with the liquid applied is conveyed to the U-turn conveyance unit and then to the conveyance unit 3. The U-turn conveyance unit is provided with the duplex conveyance unit 8 for back-surface printing. The recording sheet with the image recorded on the front surface of the recording sheet is conveyed to the duplex conveyance unit 8 and then to the liquid application unit 12 again. The liquid application unit 12 applies the liquid to the back surface of the recording sheet. The recording sheet with the image recorded on the front surface and with the liquid applied to the back surface is conveyed to the conveyance unit 3.

The liquid application unit 12 includes a liquid application mechanism that applies preprocess liquid to the conveyed recording sheet, and a liquid supply mechanism that supplies the preprocess liquid to the liquid application mechanism.

Figure 5:
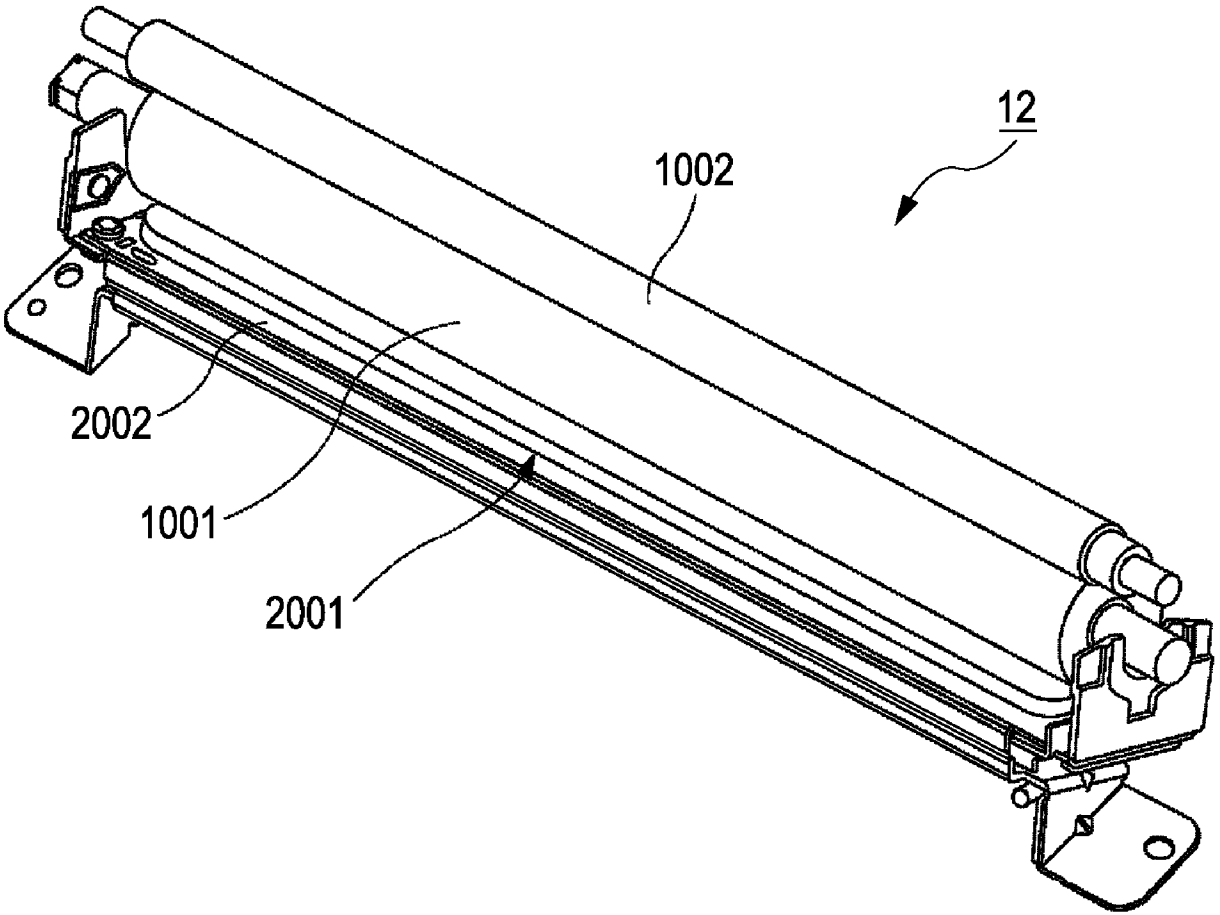
FIG. 5 is a perspective view showing a liquid application mechanism of the multifunction apparatus shown in FIG. 1.
Figure 6:
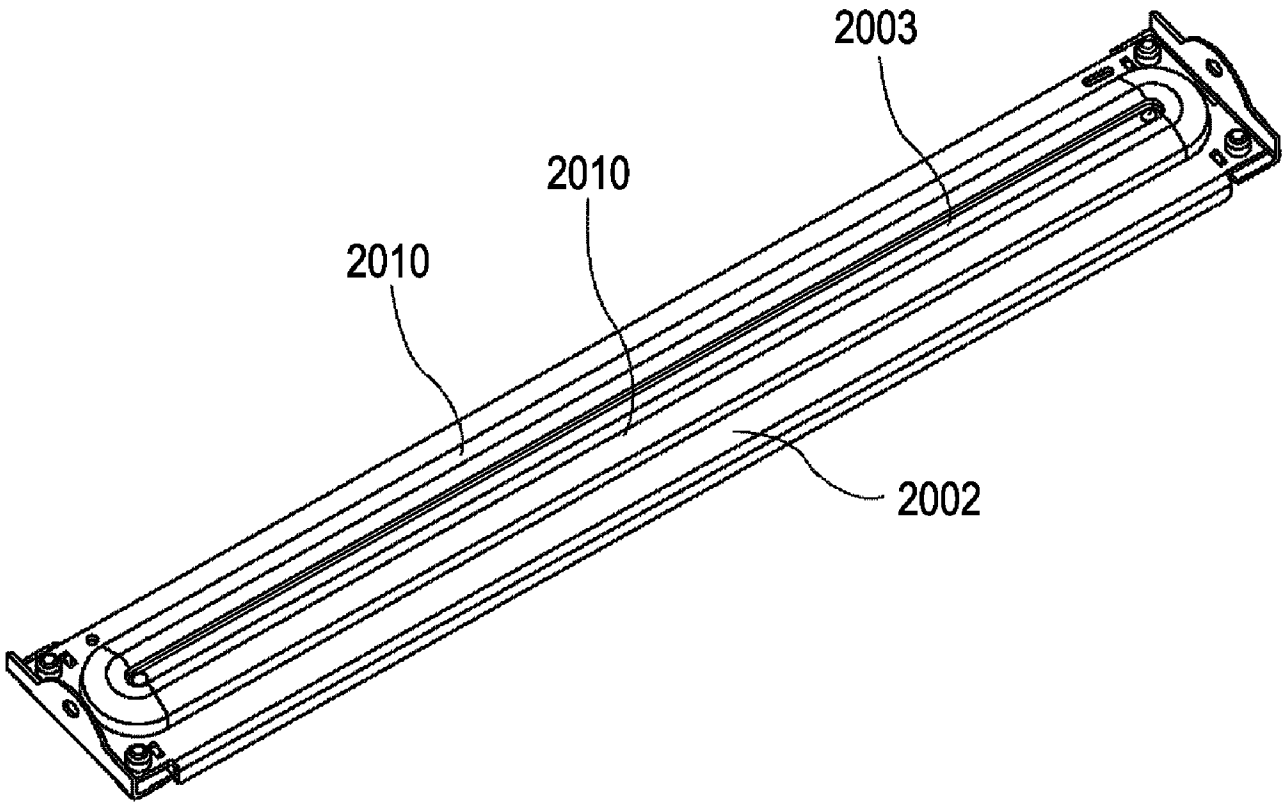
FIG. 6 is a perspective view showing a liquid retaining member of the liquid application mechanism shown in FIG. 5.

FIG. 5 is a perspective view showing the liquid application mechanism. FIG. 6 is a perspective view showing a liquid retaining member of the liquid application mechanism. The liquid application mechanism includes a cylindrical application roller 1001. The application roller 1001 contacts a liquid retaining member 2001 and forms a liquid retaining space. Application liquid in the liquid retaining space is spread over the entire surface of the application roller 1001 as the application roller 1001 is rotated. The application liquid is applied to the recording surface of the recording sheet. The application liquid promotes cohesion of pigment ink as described above. A cylindrical counter roller 1002 is arranged to face the application roller 1001, and urged against the application roller 1001 by an urging mechanism such as a spring. The application roller 1001 is rotationally driven by a drive mechanism (not shown). The counter roller 1002 is driven by the application roller 1001. When the recording sheet is conveyed through a nip portion between the application roller 1001 and the counter roller 1002, the preprocess liquid is applied to the recording sheet. The drive mechanism of the application roller 1001 includes a roller drive motor and a drive force transmission mechanism having a gear train that transmits a drive force of the roller drive motor to the application roller 1001.

The liquid retaining member 2001 includes a cap metal plate 2002, and a contact member 2010 on the cap metal plate 2002. The contact member 2010 includes two parallel straight parts and arcuate parts connecting the straight parts. A recess 2003 defining the liquid retaining space is formed at a center portion of the contact member 2010. The application roller 1001 is made of a silicone rubber material. A rubber part of the contact member 2010 is made of an EPDM rubber material. Therefore, when the application roller 1001 is rotated without the application liquid, the rubber part of the application roller 1001 directly contacts the rubber part of the contact member 2010. This causes a seriously large sliding load to be generated. The roller drive motor may not rotate the application roller 1001. To avoid this, a sheet with a low frictional coefficient, for example, made of PTFE, is attached to the rubber part of the contact member 2010. The straight parts of the contact member 2010 are fixed along an upper edge of the recess 2003, so that a peripheral part extends from the upper edge to a lower edge. With the structure, the contact member 2010 can contact the application roller 1001 along the peripheral shape of the application roller 1001.

Both ends of shafts of the application roller 1001 and the counter roller 1002 are rotatably attached to a frame (not shown). Also, the liquid retaining member 2001 extends substantially entirely along the application roller 1001 in a longitudinal direction.

Figure 7:
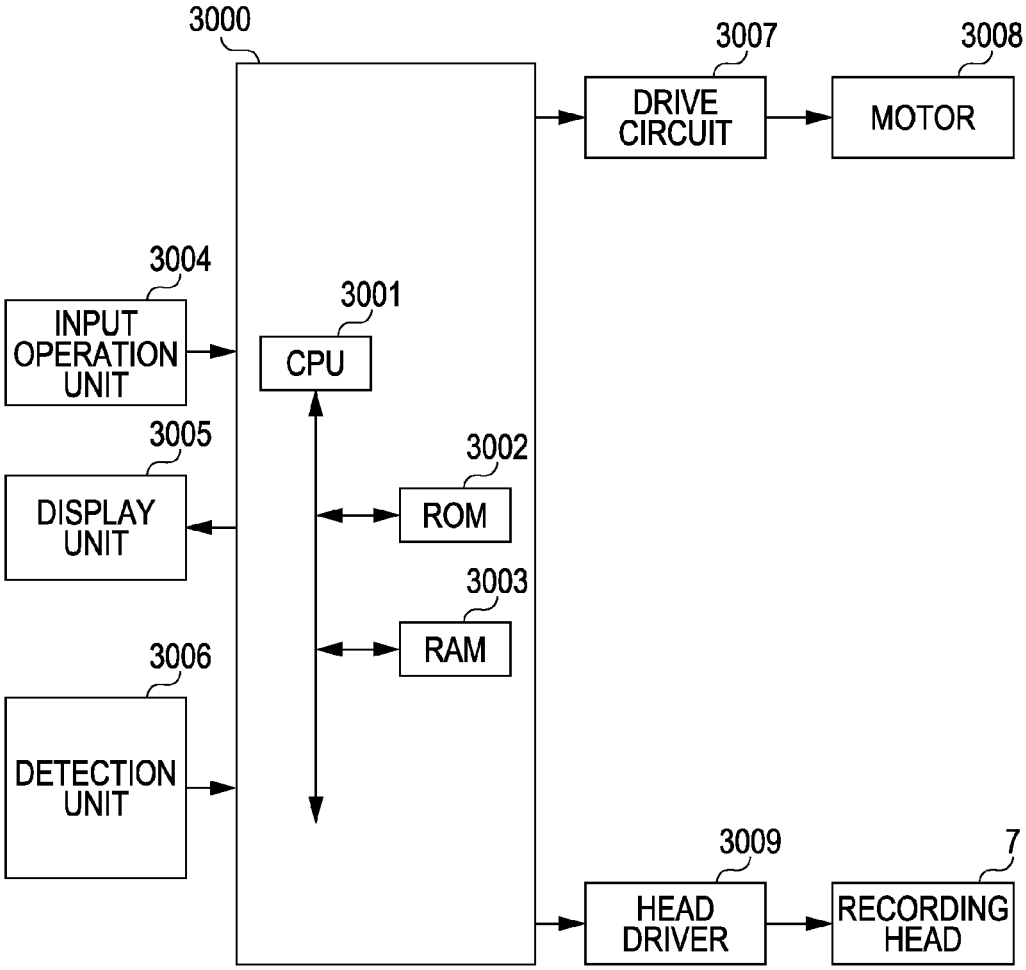
FIG. 7 is a block diagram showing a control configuration of the recording apparatus according to the embodiment of the present invention.

FIG. 7 is a block diagram showing a control configuration of the recording apparatus according to the embodiment of the present invention. In FIG. 7, a control unit 3000 controls the entire recording apparatus. The control unit 3000 includes a CPU 3001 that executes processing operations including various calculation, control, and determination. The control unit 3000 includes a ROM 3002 that stores a control program (described later) executed by the CPU 3001, and a RAM 3003 that temporarily stores data during processing with the CPU 3001, and input data. The control unit 3000 receives a predetermined instruction or predetermined data from an input operation unit 3004. The control unit 3000 causes a display unit 3005 to display input and setting states of the recording apparatus. The control unit 3000 is connected to a detection unit 3006 including a sensor that detects the position of the recording sheet and the operation states of the respective units. The control unit 3000 is connected to motors 3008 including the feed motor and the conveyance motor via a drive circuit 3007. Further, the control unit 3000 is connected to the recording head 7 via a head driver 3009.

Figure 8:
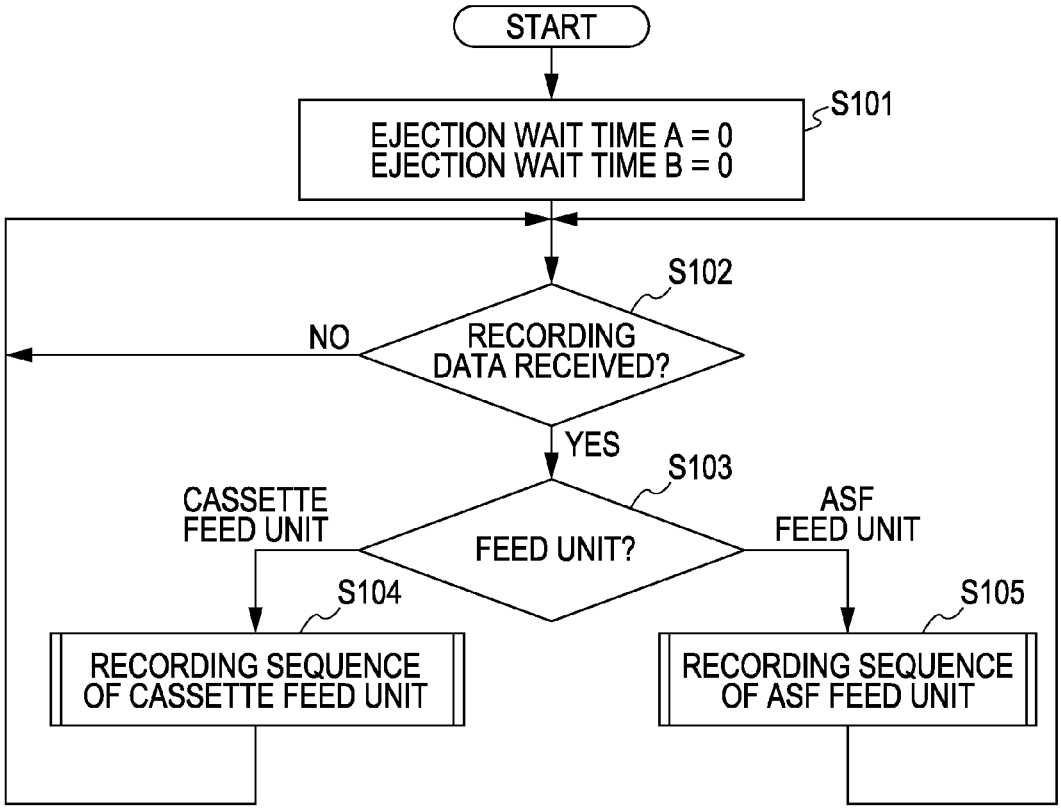
FIG. 8 is a flowchart showing a recording sequence of the recording apparatus.

FIG. 8 is a flowchart showing a recording sequence of the recording apparatus. When power is supplied to the recording apparatus 1, in step S101, 0 is substituted for an ejection wait time A and an ejection wait time B. Then, in step S102, it is determined whether or not recording data is received. If no recording data is received (NO in step S102), step S102 is repeated. If the recording data is received (YES in step S102), the sequence goes to step S103. In step S103, designation of the feed unit to feed a recording sheet is recognized. If the cassette feed unit 10 is designated (CASSETTE FEED UNIT in step S103), the sequence goes to step S104, in which a recording sequence of the cassette feed unit 10 is performed. If the ASF feed unit 2 is designated (ASF FEED UNIT in step S103), the sequence goes to step S105, in which a recording sequence of the ASF feed unit 2 is performed.

Figure 9:
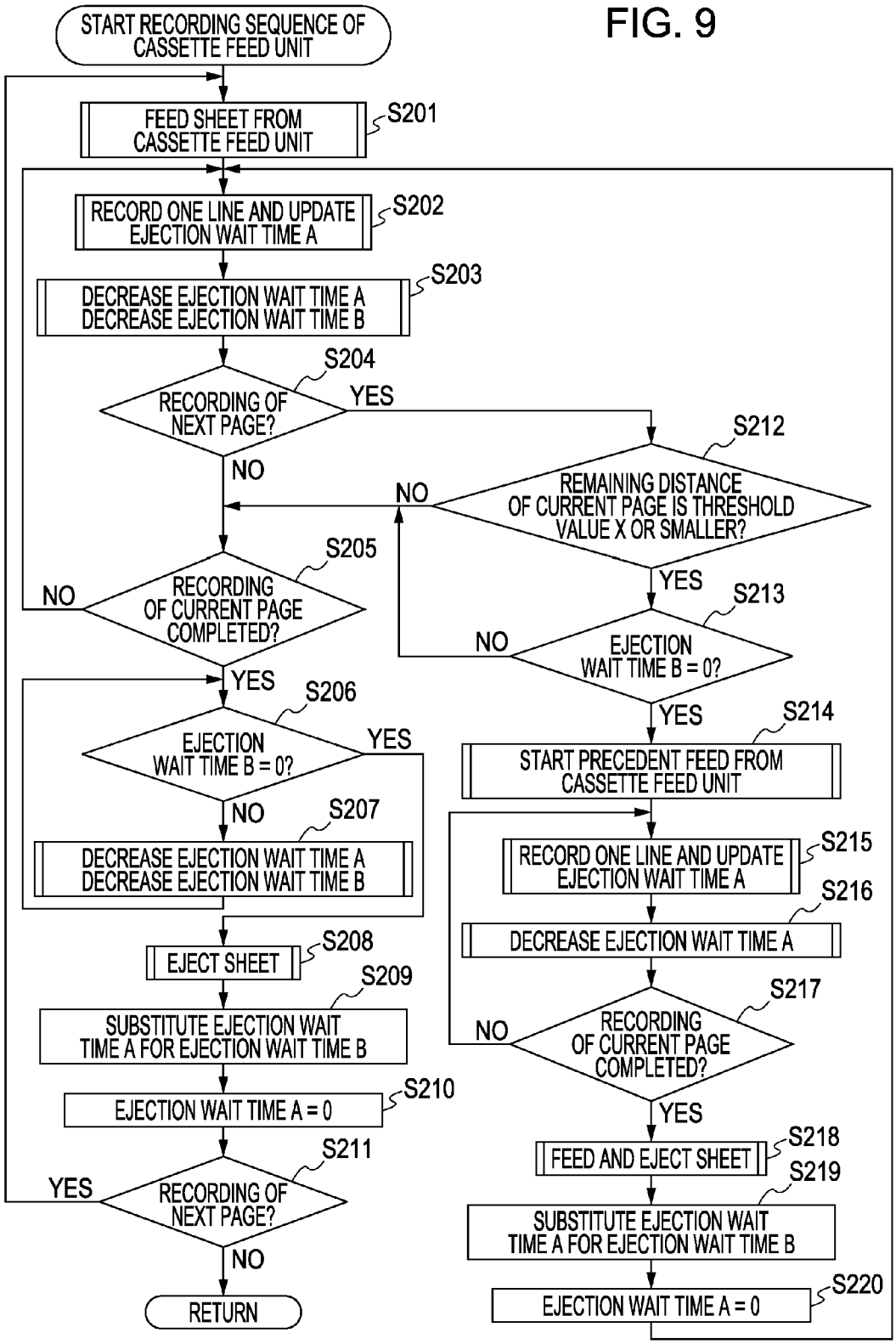
FIG. 9 is a flowchart showing a recording sequence with a cassette feed unit.

First, an operation with the cassette feed unit 10 is described with reference to FIG. 9. FIG. 9 is a flowchart showing a recording sequence of the cassette feed unit.

In step S201, a recording sheet stacked on the cassette 81 is fed by the feed roller 821. The feed roller 821 is rotated by one turn to pick up a single recording sheet. Also, the application roller 1001, the first U-turn roller 86, the conveyance roller 36, and the ejection rollers 40 and 41 are rotated to convey the recording sheet to the recording unit. The front edge of the recording sheet rotates the PE sensor lever 321, and accordingly, the PE sensor 32 detects the front edge of the recording sheet. By controlling the conveyance amount of the recording sheet since the front edge of the recording sheet is detected, the recording sheet is stopped such that a recording start position of the recording sheet is located at a position facing the recording head 7.

Then, in step S202, recording for one line is performed. In particular, ink is discharged from the recording head 7 in accordance with recording data while the carriage 50 is moved. Thusly, recording is provided on the recording sheet. In addition, in step S202, the ejection wait time A is updated. Here, an ejection wait time is a time required to wait from when recording is provided on the recording sheet (previous page) to when a next recording sheet (current page) contacts the previous page. The above-mentioned configuration defines an ejection wait time management unit that manages the time required to wait until the current page contacts the previous page ejected by the ejection unit. When the recording sheet (previous page) has been ejected on the ejection tray 46, and when recording is performed on the next recording sheet (current page) and is to be ejected on the previous page, the control unit stops ejection of the current page if the ejection wait time is not 0. Here, continuous recording is performed, and hence, it is assumed that an ejection wait time for a recording sheet which is currently recorded is an ejection wait time A, and that an ejection wait time for a recording sheet which has been ejected is an ejection wait time B.

The ejection wait time is determined with regard to a part of the recording sheet at which an ink discharge amount per unit area is the maximum when the one-line recording is performed. At this time, referring to a table in FIG. 11, the ejection wait time is 0 second when the ink amount per unit area is 49% or lower, the ejection wait time is 10 seconds when the ink amount per unit area is in a range of from 50% to 69%, the ejection wait time is 20 seconds when the ink amount per unit area is in a range of from 70% to 84%, and the ejection wait time is 30 seconds when the ink amount per unit area is in a range of from 85% or higher. After the ejection wait time is determined with the one-line recording, a timer provided in the control unit 3000 counts down the ejection wait time. The ejection wait time does not become a value smaller than 0 by the countdown.

If the ejection wait time, which is determined with reference to the table in FIG. 11 with the one-line recording, is longer than a previous ejection wait time before the one-line recording, the determined ejection wait time is updated to the longer value. If the ejection wait time, which is determined with reference to the table in FIG. 11 with the one-line recording, is shorter than the previous ejection wait time before the one-line recording, the determined ejection wait time is not updated. For example, if the ink amount per unit area with the one-line recording is 71%, the ejection wait time determined with reference to the table in FIG. 11 is 20 seconds. Then, if the previous ejection wait time before the one-line recording is 15 seconds, the ejection wait time is updated to 20 seconds. If the previous ejection wait time before the one-line recording is 25 seconds, the ejection wait time is held 25 seconds.

Then, in step S203, the ejection wait time A which is the ejection wait time of the current page, and the ejection wait time B which is the ejection wait time of the previous page are decreased. In particular, an elapsed time counted by the timer is subtracted from the ejection wait time which has been decreased first or which has been updated. As described above, the ejection wait time does not become smaller than 0.

Then, in step S204, it is determined whether or not recording data of the next page is present. If it is determined that the recording data is present (YES in step S204), the sequence goes to step S212. If it is determined that the recording data is not present (NO in step S204), the sequence goes to step S205.

Then, in step S205, it is determined whether or not recording of the current page is completed. If the recording is not completed (NO in step S205), the sequence returns to step S202, and steps S202 to S205 are repeated until the recording is completed. If the recording is completed (YES in step S205), the sequence goes to step S206.

In step S206, the value of the ejection wait time B which is the ejection wait time of the previous page is recognized. If the ejection wait time B is not 0, ejection of the current page is not permitted. If the ejection wait time B is not 0 (NO in step S206), the ejection wait time is decreased in step S207, and then the sequence returns to step S206. Steps S206 and S207 are repeated until the ejection wait time B becomes 0. If the ejection wait time B is 0 (YES in step S206), the ejection of the current page is permitted, and hence, the sequence goes to step S208. The configuration defines an ejection permission unit configured to permit the current page to be ejected by the ejection unit when a time managed by the ejection wait time management unit becomes 0.

In step S208, the current page is ejected. In particular, the PE sensor 32 detects the rear edge of the current page, and then, a sheet is conveyed by a predetermined conveyance amount necessary for ejecting the sheet.

After the ejection of the current page is completed, in step S209, the ejection wait time A managed as the ejection wait time of the ejected current page is substituted for the ejection wait time B which is the ejection wait time of the previous page. Accordingly, the ejection of the next page before recording can be controlled on the basis of the ejection wait time corresponding to the recording density of the current page.

In step S210, the ejection wait time A which is the ejection wait time for the next page before recording (the next page will be a current page when recording is started) is initialized to be 0.

In step S211, it is determined whether or not recording data of the next page is present. This step is provided because new data is sometimes sent after the presence of the recording data is determined in step S204. If it is determined that the recording data is present (YES in step S211), the sequence returns to step S202. If it is determined that the recording data is not present (NO in step S211), the recording sequence is ended.

Then, the procedure when it is determined that the recording data of the next page is present in step S204 and then the sequence goes to step S212 is described. In step S212, it is determined whether or not a remaining distance of recording of the current page is a threshold value X or smaller. The remaining distance of recording is a distance from a position at which recording is provided by the recording head to a rear edge of the current page. The conveyance amount is determined as the sensor arranged near the feed roller 821 detects the rear edge of the current page. Then, the remaining distance is controlled using the conveyance amount. Here, referring to a table in FIG. 12, the threshold value X is different depending on a printing mode. This configuration defines a feed control unit configured to start feed of the next page by the feed unit before the recording of the current page by the recording head is completed. A threshold value X in a black and white mode is 150 mm, and a threshold value X in a color mode is 100 mm. The black and white printing mode provides printing with a higher speed than the speed of printing in the color printing mode. Thus, the value in the black and white printing mode is set larger. The first U-turn roller 86 is used for precedent feed (described later), and hence the threshold value X is smaller than a distance between the first U-turn roller 86 and the conveyance roller 36.

In step S213, the ejection wait time B is recognized. If the ejection wait time B is 0 (YES in step S213), the sequence goes to step S214. If the ejection wait time B is not 0 (NO in step S213), the sequence goes to step S205.

In step S214, the precedent feed of the next page is started from the cassette feed unit. In particular, the feed roller 821 is rotated by one turn to pick up the next page. Also, the application roller 1001 and the first U-turn roller 86 are rotated to convey the next page to the recording unit. At this time, the conveyance roller 36, and the ejection rollers 40 and 41 are conveying the current page.

In step S215, recording for one line is performed, and the ejection wait time A is updated, in a similar manner to step S202. In step S216, the ejection wait time A is decreased. In particular, an elapsed time counted by the timer is subtracted from an ejection wait time A before the one-line recording. Since the ejection wait time B is originally 0, no subtraction is applied.

In step S217, it is determined whether or not recording of the current page is completed. If the recording is not completed (NO in step S217), the sequence returns to step S215, and steps S215 to S217 are repeated until the recording is completed. If the recording is completed (YES in step S217), the sequence goes to step S218.

In step S218, sheets are fed and ejected. In particular, the conveyance roller 36, and the ejection rollers 40 and 41 are rotated to eject the current sheet. Also, the next page precedently fed in step S214 is conveyed, and the PE sensor 32 detects a front edge of the next page. The conveyance amount since the PE sensor 32 detects the front edge of the next page is controlled, so that a recording start position of the next page is controlled to be located at a position facing the recording head 7. Subsequent steps S219 and S220 are similar to steps S209 and S210 described above. Then, the sequence returns to step S202.

Figure 10:
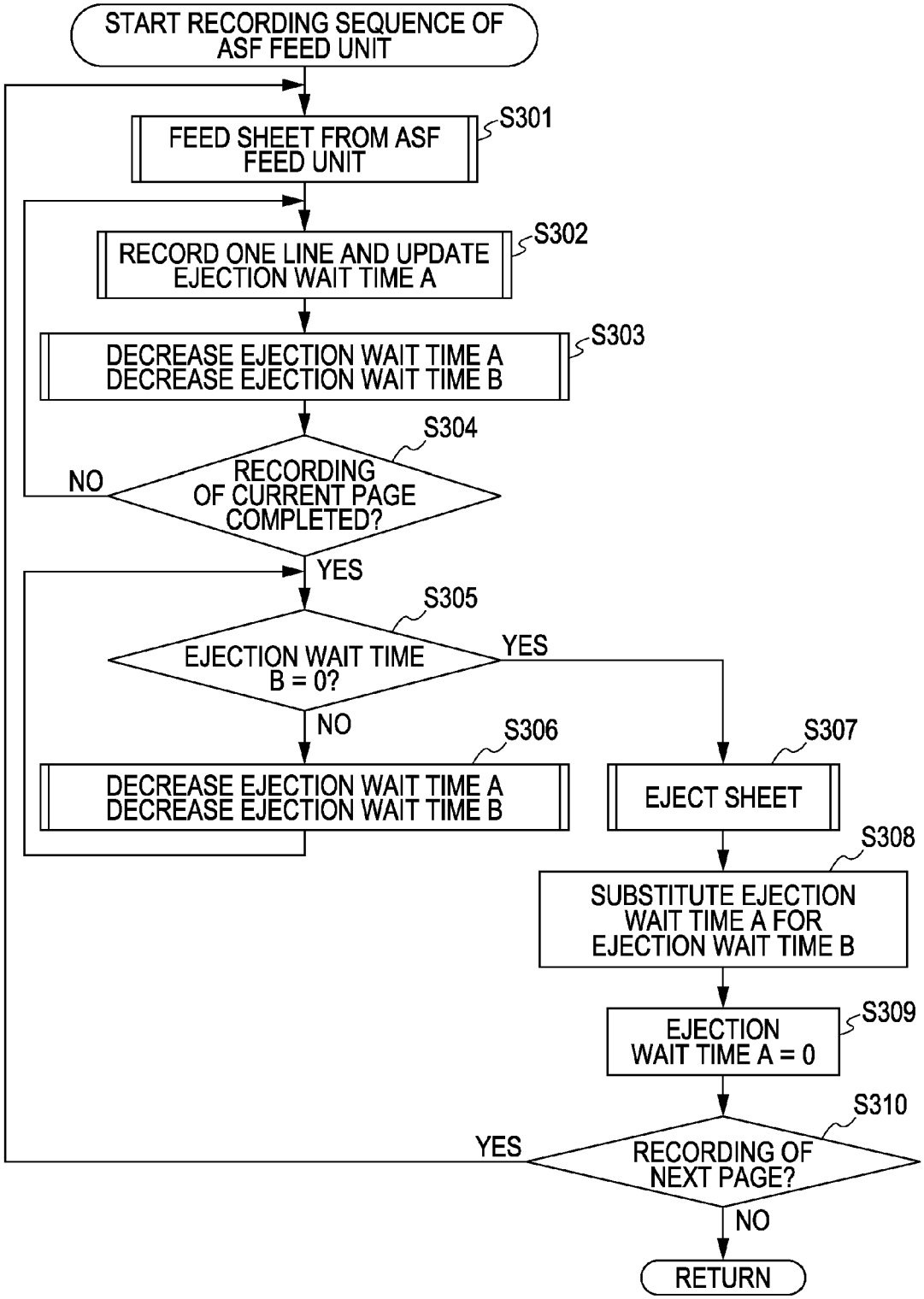
FIG. 10 is a flowchart showing a recording sequence with an ASF feed unit.

Second, an operation with the ASF feed unit 2 is described with reference to FIG. 10. FIG. 10 is a flowchart showing a recording sequence with the ASF feed unit. The ASF feed unit feeds a recording sheet to the recording unit without the recording sheet passing through the application unit.

In step S301, a recording sheet stacked on the pressure plate 21 is fed by the feed roller 28. The feed roller 28 is rotated by one turn to pick up a single recording sheet. Also, the conveyance roller 36, and the ejection rollers 40 and 41 are rotated to convey the recording sheet to the recording unit. The front edge of the recording sheet rotates the PE sensor lever 321, and accordingly, the PE sensor 32 detects the front edge of the recording sheet. By controlling the conveyance amount of the recording sheet since the front edge of the recording sheet is detected, the recording sheet is stopped such that a recording start position of the recording sheet is located at a position facing the recording head 7.

Then, in step S302, recording for one line is performed. In particular, ink is discharged from the recording head 7 in accordance with recording data while the carriage 50 is moved. Thusly, recording is provided on the recording sheet. In addition, in step S302, the ejection wait time A is updated, in a similar manner to step S202.

Then, in step S303, the ejection wait time A and the ejection wait time B are decreased, in a similar manner to step S203.

Then, in step S304, it is determined whether or not recording of the current page is completed. If the recording is not completed (NO in step S304), the sequence returns to step S302, and steps S302 to S304 are repeated until the recording is completed. If the recording is completed (YES in step S304), the sequence goes to step S305.

In step S305, the ejection wait time B is recognized. If the ejection wait time B is not 0, ejection of the current page is not permitted. If the ejection wait time B is not 0 (NO in step S305), the ejection wait time is decreased in step S306, and then the sequence returns to step S305. Steps S305 and S306 are repeated until the ejection wait time B becomes 0. If the ejection wait time B is 0 (YES in step S305), the ejection of the current page is permitted, and hence, the sequence goes to step S307.

In step S307, the current page is ejected, in a similar manner to step S208.

After the ejection of the current page is completed, in step S308, the ejection wait time A is substituted for the ejection wait time B. Accordingly, the ejection of the next page to be recorded can be controlled on the basis of the ejection wait time corresponding to the recording density of the current page.

In step S309, the ejection wait time A which is the ejection wait time of the next page to be recorded (the next page will be a current page when recording is started) is initialized to be 0.

In step S310, it is determined whether or not recording data of the next page is present. If it is determined that the recording data is present (YES in step S310), the sequence returns to step S301. If it is determined that the recording data is not present (NO in step S310), the recording sequence is ended.

As described above, with this embodiment, the preprocess liquid can be prevented from being unevenly applied as a result of that the precedently fed recording sheet (next page) is stopped during application of the preprocess liquid, the recording sheet (next page) being stopped because the recording sheet during recording (current page) waits for being ejected until the recording sheet (current page) is permitted to contact the recording sheet (previous page) which has been previously ejected. Thus, a recording apparatus can be provided, which is capable of providing recording with high image quality while preventing smear due to an ejected sheet from occurring, in a configuration that applies preprocess liquid to a recording medium by an application roller before a recording head performs recording.

In the above-described embodiment, in step S212 in FIG. 9, the remaining distance of recording of the current page is controlled using the conveyance amount since the sensor arranged near the feed roller 821 detects the rear edge of the current page. In this embodiment, the sensor near the feed roller 821 is omitted. A remaining distance of recording of the current page is calculated on the basis of a length L of a sheet indicated by recording data, and a conveyance amount La since the PE sensor 32 detects the front edge of the sheet.

With this embodiment, since no sensor is provided near the feed roller, timing of the precedent feed can be controlled with a simple structure.

With the embodiments of the present invention, a recording apparatus can be provided, which is capable of providing recording with high image quality while preventing smear due to an ejected sheet from occurring, in a configuration that applies preprocess liquid to a recording medium by an application roller before a recording head performs recording can be provided.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-149368 filed Jun. 6, 2008, which is hereby incorporated by reference herein in its entirety.

What is claimed is:

1. An inkjet recording apparatus, comprising:

a feed unit configured to feed a recording medium;

an application unit configured to apply liquid to the recording medium fed by the feed unit;

a recording unit configured to perform recording by applying ink from a recording head on the recording medium with the liquid applied by the application unit;

an ejection unit configured to eject the recording medium after the recording is performed by the recording unit; and a control unit configured to, when the recording medium includes a plurality of pages, start feed of a next page by the feed unit before recording of a current page by the recording head is completed, wherein the control unit is configured to manage a first time until a previous page, which has already been ejected by the ejection unit, is permitted to contact with the current page, and to manage a second time until the current page is permitted to contact with the next page, and wherein the control unit is configured to start ejection of the current page by the ejection unit based on the first time.

2. The inkjet recording apparatus according to claim 1, wherein a distance between the application unit and the recording unit along a conveyance pate is equal to or greater than a length of the recording medium.

3. The inkjet recording apparatus according to claim 1, wherein the control unit determines an initial value of the first time based on an ink amount per unit area applied to the previous page, and an initial value of the second time based on an ink amount per unit area applied to the current page.

4. The inkjet recording apparatus according to claim 1, further comprising a sensor arranged between the feed unit and the recording unit along a conveyance path and configured to detect the presence of the recording medium.

5. The inkjet recording apparatus according to claim 4, wherein the sensor is arranged between the feed unit and the application unit along a conveyance path.

6. The inkjet recording apparatus according to claim 5, wherein the control unit starts the feed of the next page on the basis of a conveyance amount of the current page where the sensor detects a rear edge of the current page.

7. The inkjet recording apparatus according to claim 6, wherein the feed control unit has threshold values to start the feed of the next page, the threshold values being different for a black and white printing mode and a color printing mode.

8. The inkjet recording apparatus according to claim 4, wherein the sensor is arranged between the application unit and the recording unit along a conveyance path.

9. The inkjet recording apparatus according to claim 8, wherein the control unit starts the feed of the next page on the basis of a length of the current page indicated by recording data and a conveyance amount of the current page since the sensor detects a front edge of the current page.

10. The inkjet recording apparatus according to claim 9, wherein the control unit has threshold values to start the feed of the next page, the threshold values being different for a black and white printing mode and a color printing mode.

11. The inkjet recording apparatus according to claim 1, further comprising a second feed unit configured to feed the recording medium to the recording unit without the recording material passing through the application unit, wherein the recording unit is configured to perform recording on the recording medium without the liquid applied by the application unit fed from the second feed unit.

12. The inkjet recording apparatus according to claim 1, wherein the apparatus is capable of performing two-sided printing, and the apparatus further comprising a duplex conveyance unit configured to reverse the recording medium, the duplex conveyance unit comprising a conveyance path through which the recording medium fed by the feeding unit being conveyed to the application unit.

13. The inkjet recording apparatus according to claim 12, wherein a distance between the application unit and the recording unit along the conveyance path is equal to or greater than a length of the recording medium.

* * * * *